US005393166A

United States Patent [19]

Stock et al.

[11] Patent Number: 5,393,166

[45] Date of Patent: Feb. 28, 1995

[54] REFLECTIVE MARKER FROM RECYCLABLE MATERIAL

[75] Inventors: Anthony P. Stock, Nanaimo; Daniel B. O'Brien, Victoria; James A. Sloan, Yellow Point, all of Canada

[73] Assignee: Target Recycling Inc., Chemainus, Canada

[21] Appl. No.: 58,218

[22] Filed: May 10, 1993

[51] Int. Cl.[6] ..... E01F 9/06

[52] U.S. Cl. ..... 404/14; 404/16

[58] Field of Search ..... 404/9, 10, 12, 13, 14, 404/15, 16

[56] References Cited

U.S. PATENT DOCUMENTS

| | | | |
|---|---|---|---|
| 1,833,124 | 11/1931 | Rand | 404/10 |
| 3,332,327 | 7/1967 | Heenan | 94/1.5 |
| 3,409,344 | 11/1968 | Balint et al. | 404/14 X |
| 3,485,148 | 12/1969 | Heenan | 404/12 |
| 3,627,403 | 12/1971 | Hedgewick | 350/103 |
| 3,758,191 | 9/1973 | Hedgewick | 404/16 X |
| 3,784,279 | 1/1974 | Hedgewick | 350/103 |
| 3,785,719 | 1/1974 | Jonnes | 404/14 X |
| 3,833,285 | 9/1974 | Heenan | 350/103 |
| 3,879,148 | 4/1975 | Eigenmann | 404/14 X |
| 3,934,540 | 1/1976 | Bruner et al. | 116/63 |
| 3,936,208 | 2/1976 | Baynes et al. | 404/16 |
| 3,972,586 | 8/1976 | Arnott et al. | 350/106 |
| 4,232,979 | 11/1980 | Johnson, Jr. et al. | 404/16 |
| 4,340,319 | 7/1982 | Johnson, Jr. et al. | 404/16 |
| 4,596,622 | 6/1986 | Heenan et al. | 156/275.5 |
| 4,697,294 | 10/1987 | Schäfer | 404/16 X |
| 4,726,706 | 2/1988 | Attar | 404/14 |
| 4,875,798 | 10/1989 | May | 404/12 |
| 5,002,424 | 3/1991 | Hedgewick | 404/14 |
| 5,061,114 | 10/1991 | Hedgewick | 404/14 |
| 5,156,486 | 10/1992 | Davidson | 404/6 |

FOREIGN PATENT DOCUMENTS

| | | | |
|---|---|---|---|
| 2532541 | 12/1976 | Germany . | |
| 2534300 | 2/1977 | Germany . | |
| 2104946 | 3/1983 | United Kingdom | 404/16 |

*Primary Examiner*—Ramon S. Britts
*Assistant Examiner*—James A. Lisehora
*Attorney, Agent, or Firm*—Bull, Housser & Tupper

[57] ABSTRACT

A reflective marker apparatus comprises a resilient, elastic body portion having an attachment surface, a top surface adjacent the attachment surface and first and second oppositely disposed face sides angularly disposed relative to the attachment surface to be convergent toward the top surface. A reflecting device is secured to at least one of the first and second face sides for reflecting light generally directed at the face sides. The body is preferably formed from a portion of a rubber tire to form a solid, unitary body. There is also disclosed a method of marking a point in a vehicular traffic area, the method including the steps of attaching to the point a body formed entirely from at least a portion of a rubber tire and having a reflecting surface thereon and using the reflecting surface to reflect light received from the lights of a nearby vehicle, such that reflected light is directed back at the vehicle. In addition, there is described a reflector for general application on vehicle area markers.

7 Claims, 4 Drawing Sheets

REFLECTIVE MARKER FROM RECYCLABLE MATERIAL

BACKGROUND OF THE INVENTION

This invention relates to devices for marking a position on a vehicular traffic area such as a road, runway or other designated area in which vehicles having lights are permitted to travel. In particular, the invention relates to a reflective marker made from recyclable material such as used rubber tires. Devices according to this invention may be used as reflective markers on highways, such as to designate lanes and shoulders, for example.

Reflective markers for use on roadways have been in existence for some time. Such devices are described in U.S. Pat. Nos. 4,875,798 to May; 3,972,586 to Arnott; and 4,232,979 and 4,340,319 to Johnson et al. Generally, the devices disclosed in these patents employ a two-piece construction including a body and a reflective member secured to the body. Typically, the body and the reflective member are made from different materials having different physical properties including different coefficients of heat expansion and different degrees of elasticity and resilience.

Other reflective markers such as those described in U.S. Pat. Nos. 3,332,327 to Heenan; 5,002,424, 3,784,279, and 3,627,403 to Hedgewick; and 4,726,706 to Attar describe devices in which a reflector portion acts as a housing for receiving potting material to form a base. The reflector portion and base portion are therefore also made of different materials having different physical properties.

In most cases, the materials used to form the body and the reflective member are usually hard materials having little elasticity and resilience. Such material is prone to cracking due to constant heat cycling due to temperature differences between day and night and cracking due to mechanical stresses imposed by vehicular traffic driving over the device. Consequently, such devices must be replaced from time to time. Replacement of reflective markers is presently quite costly as the entire marker must be removed from the road surface and replaced with a new one. Therefore, there is a need to provide reflective markers better able to withstand the physical demands of heat expansion and contraction and physical stresses to due vehicular traffic and preferably such markers are easily serviceable to permit replacement of the reflecting portion thereof.

Notwithstanding the above, each of the devices described in the above patents, is produced by processing raw or prepared materials specifically designed and formed into shapes determined by their designers. For example Heenan '622 discloses the use of an acrylic reflector member and a body formed from liquid urethane resin which cures in the plastic reflector housing. Both the acrylic reflector and the urethane resin are created from raw materials and once created can only be disposed of by burning. With society's increasing desire to depart from the use of non-recyclable materials, use of the Heenan reflectors is becoming undesirable. There is, therefore, a demand for devices which perform generally the same purpose as the above described devices, but made from recycled or recyclable materials. The present invention addresses this demand.

SUMMARY OF THE INVENTION

In accordance with one aspect of the invention there is provided a reflective marker apparatus for use in a vehicular traffic area, the apparatus comprising a resilient, elastic body portion having an attachment surface, a top surface adjacent the attachment surface and first and second oppositely disposed face sides angularly disposed relative to the attachment surface to be convergent toward the top surface. Reflecting means are secured to at least one of the first and second face sides for reflecting light generally directed at said at least one of the first and second face sides.

Preferably, the body is formed from at least one flat, generally rectangular portion of a rubber tire forming a solid unitary body having a truncated pyramidal shape.

Also preferably, the top surface of the body is flat and the body has a groove extending transversely in the top surface and a recessed portion in the attachment surface. Preferably the reflecting means includes a resilient reflector member having a light reflecting portion and first and second tabs extending from the reflecting portion. The first and second tabs cooperate with the groove and the recessed portion in the body to secure the reflector member to the body. The use of the recessed portions and the grooves permit the cover portion to be removed from the body, even when the apparatus is installed on a road. A screwdriver may be used to pry the cover portion off of the body portion. While this may result in breakage of the cover portion, it permits the cover portion to be replaced in the event that it becomes damaged due to moisture ingress or mechanical fatigue. Thus apparatus according to this embodiment are more serviceable than conventional reflective markers.

In accordance with another aspect of the invention, there is provided a reflective marker apparatus for use in vehicular traffic areas, the apparatus comprising first and second flat, generally rectangular portions of a rubber tire laminated together to form a solid unitary body having an attachment surface, a top surface opposite the attachment surface and first and second oppositely disposed face sides angularly disposed relative to the attachment surface to be convergent toward the top surface.

Reflecting means are secured to at least one of the first and second face sides for reflecting light generally directed at the face sides.

In accordance with another aspect of the invention, there is provided a vehicular traffic area marker apparatus comprising a resilient, elastic, generally rectangular member having a first portion having a securing surface and a second upstanding portion, upstanding relative to the first portion, the member being sufficiently elastic to permit the second upstanding portion to be bent to an angle of up to approximately 180 degrees relative to the first portion. Reflecting means are secured to the second upstanding portion for reflecting light generally directed at the upstanding portion.

In one embodiment, the first portion has a greater mass than the second upstanding portion such that the member has a low centre of gravity, thereby tending to keep the member oriented such that the first portion is generally below the second upstanding portion. The second upstanding portion has reflecting means thereon, the reflecting means being kept upright due to the low centre of gravity of the device.

According to another aspect of the invention, there is further disclosed a method of marking a point in a vehicular traffic area, the method including the steps of attaching to the point a body formed entirely from at least a portion of a rubber tire and having a reflecting surface thereon and using the reflecting surface to reflect light received from the lights of a nearby vehicle, such that reflected light is directed back at the vehicle.

A particularly useful feature of the invention is in the use of portions of a rubber tire to form the body portions of the various embodiments of the invention. This is advantageous because tire rubber is naturally resilient and capable of withstanding heat expansion and contraction and is robust enough to withstand the physical demands imposed by vehicular traffic. Furthermore, used rubber tires may easily be used to form the rubber tire portions, thereby providing a method of disposing of used rubber tires. In effect therefore, such used rubber tires may be recycled by use in devices described herein. The invention thereby provides an improved reflective marker while at the same time providing a way of re-using rubber tires. The invention therefore has a positive effect on the environment.

According to another aspect of the invention there is provided a cover apparatus for covering a light reflecting strip on a body portion of a vehicle area marker, the body portion having a top portion with a groove therein and a bottom portion with a recessed portion, the cover apparatus comprising a member having a light transmitting portion for covering the light reflecting strip, a top portion connected to the light transmitting portion, the top portion having a first tab operable to be received in said groove, and a second tab connected to the light transmitting portion and cooperating with the recessed portion to removably secure the member to the body portion.

In accordance with another aspect of the invention there is provided a reflector for use on a body portion of a vehicle area marker, the body portion having a face portion with a receptacle therein, the cover apparatus comprising a member having a light reflecting portion for reflecting light impinging thereon and a projection extending outwardly from said light reflecting portion, the projection cooperating with the receptacle such that the projection is removably held by said receptacle thereby removably securing the member to the body portion.

According to another aspect of the invention there is provided a reflector for use on a vehicle area marker, the reflector comprising a member removably securable to the vehicle area marker, the member including a reflecting member and a resilient clip portion parallel to and spaced apart from the reflecting member such that a portion of the vehicle area marker is received and gripped between the reflecting portion and the clip portion.

BRIEF DESCRIPTION OF THE DRAWINGS

In drawings which illustrate embodiments of the invention.

DETAILED DESCRIPTION

FIG. 1

Figure 1:
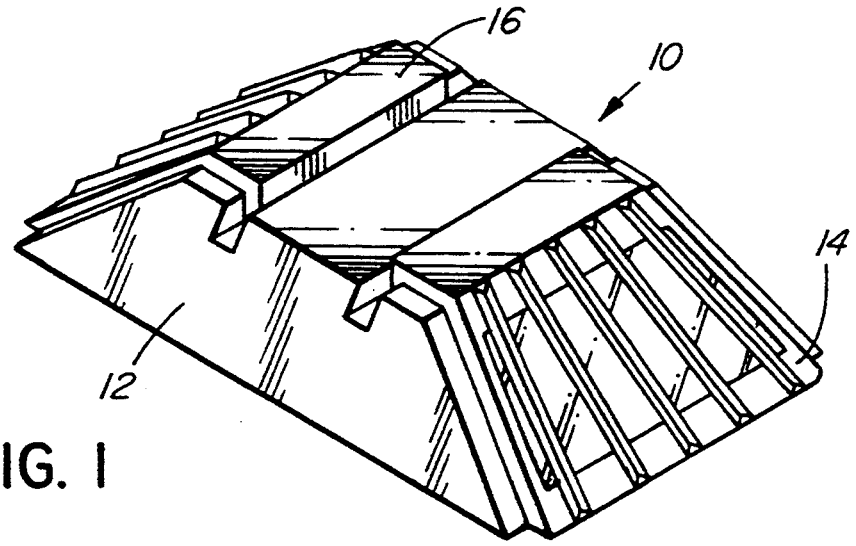
FIG. 1 is a perspective view of an apparatus according to a first embodiment of the invention.

Referring to FIG. 1, a reflective marker apparatus according to a first embodiment of the invention is shown generally at 10. The apparatus includes a resilient, elastic body portion, shown generally at 12 and first and second resilient light reflecting devices 14 and 16.

FIG. 2

Figure 2:
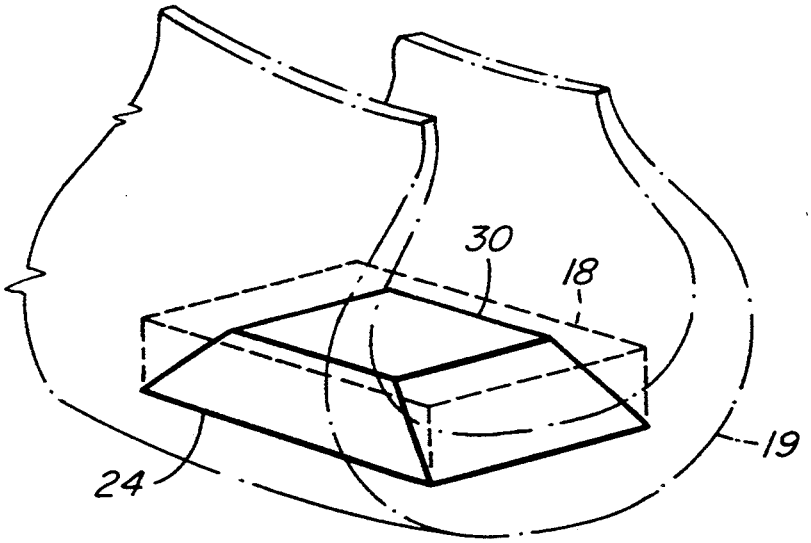
FIG. 2 is a perspective view of a block formed during an intermediate stage of making the apparatus of FIG. 1.

Referring to FIG. 2, the body portion 12 is formed from a generally rectangular slab 18 of a used rubber tire 19. The rectangular slab 18 is cut along solid lines 30 to form a body portion having a truncated pyramidal shape as seen best in FIG. 1.

FIG. 3

Figure 3:
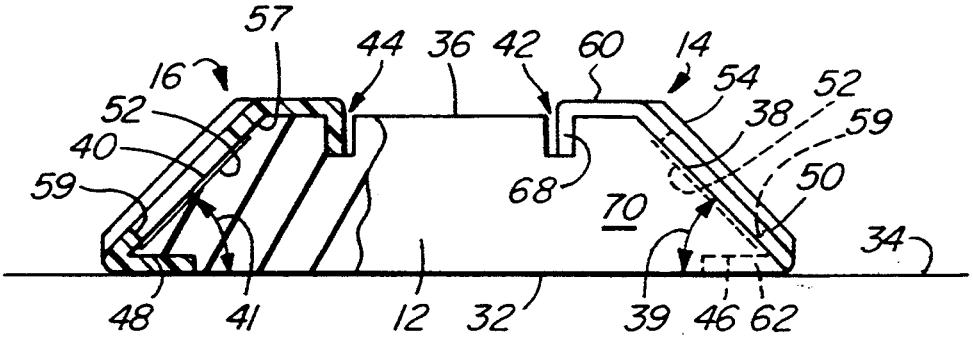
FIG. 3 is a side view of the apparatus of FIG. 1.

Referring to FIG. 3, the resulting body portion 12 has an attachment surface 32 for attaching the body to a road 34. Attachment of the body to the road is effected by applying to the attachment surface 32 a layer of bonding agent and then pressing the attachment surface to the desired point on the road. In the preferred embodiment, the bonding agent is POWERBOND 10EL (trademark), available from Industrial Formulators Ltd. of Burnaby, B.C. Canada. Powerbond 10EL is a two part epoxy based paste which resists oils and fuels and cures in 12 hours.

Opposite the attachment surface 32, the body has a flat top surface 36 and first and second face sides 38 and 40 which are angularly disposed relative to the attachment surface 32 and convergent toward the top surface 36, consistent with the truncated pyramidal shape. Preferably, the first and second face sides 38 and 40 are disposed at angles 39 and 41 of approximately 30 degrees relative to the attachment surface, which accordingly disposes the first and second reflecting devices 14 and 16 at the same angle. It has been found that this angle permits the reflecting devices 14 and 16 to reflect a reasonable amount of light, while at the same time permitting the tires of vehicles to have a cleaning effect on the reflecting devices 14 and 16 when a vehicle tire is driven over the apparatus. The angle could however, be in the range of between 15 and 60 degrees, where a 15 degree angle would present the greatest cleaning effect with little reflectivity and a 60 degree angle would provide the greatest reflectivity with little cleaning effect. The decrease in reflectivity at lower angles can be compensated by increasing the surface area of the face.

The flat top surface 36 has first and second grooves 42 and 44 extending transversely therein, parallel to and adjacent the first and second face sides 38 and 40 respectively and the attachment surface has first and second recessed portions 46 and 48 immediately adjacent the first and second face sides 38 and 40 respectively. The first groove 42 and first recessed portion 46 cooperate to secure the first reflecting device 14 to the body whereas the second groove 44 and the second recessed portion 48 cooperate to secure the second reflecting device 16 to the body.

The first and second reflecting devices 14 and 16 are similar and therefore only the first reflecting device 14 will be described, it being understood that the second reflecting device 16 is generally the same as the first reflecting device.

Figure 4:
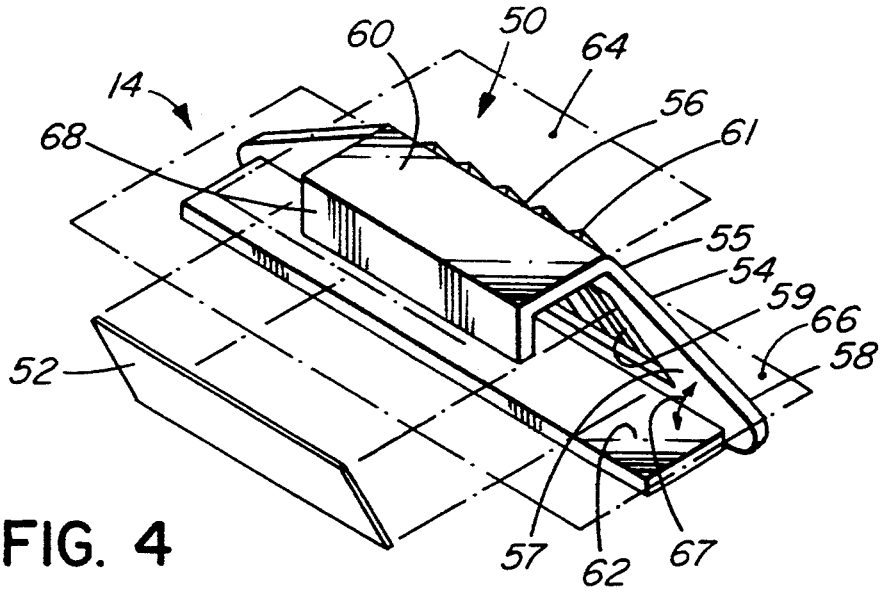
FIG. 4 is a rear perspective view of a reflector member according to the first embodiment.

Referring to FIG. 4, the first reflecting device 14 includes a cover portion 50 formed from polycarbonate plastic in an injection moulding process, and a generally rectangular strip of reflective tape 52. The cover portion 50 is transparent and has an angled, light transmitting portion 54, having upper and lower portions 56 and 58 and front and rear portions 55 and 57. The front portion 55 has a plurality of generally triangular shaped ribs 61 extending between the upper portion 56 and the lower portion 58 which provide a degree of scratch resistance to the front portion 55.

The rear portion 57 has a rectangular cavity 59 having rectangular dimensions slightly smaller than the rectangular dimensions of the strip of reflective tape 52. The strip of reflecting tape is preferably ultrasonically welded to the rear portion 57 immediately behind the cavity 59 such that the cavity lies between the light transmitting portion 54 and the strip of reflective tape 52. The use of the cavity improves the reflectivity of the device over a cover portion having no such cavity.

Extending from the upper portion 56 is a top portion 60 and extending from the lower portion 58 is a first tab 62. The top portion and first tab extend in parallel planes 64 and 66 disposed at a 30 degree angle 67 to the light transmitting portion 54, complementary to the similarly-angled first face side 38 of the body portion 12. A second tab 68 extends at right angles to the top portion 60, projecting toward the first tab 62.

Referring back to FIG. 3, the light transmitting portion 54, top portion 60 and first and second tabs 62 and 68 are dimensioned such that the first tab 62 is received in the recessed portion 46 in the body portion 12, the second tab 68 is received in the first groove 42 in the body and such that the light transmitting portion 54 and top portion 60 are closely adjacent the first face side 38 and top surface 36 respectively when the cover portion 50 is clipped onto the body portion 12. The recessed portion 46 in the body permits the first tab 62 to be received and held by the body, without causing the attachment surface to be raised up off of the road. The first tab may therefore be referred to as a projection and the recessed portion 46 may be referred to as a receptacle in the body portion for receiving and holding the projection. Similarly, the second tab 68 is received and held in the first groove 42. A first end portion 70 of the body is therefore tightly gripped by the first and second tabs 62 and 68. Hence, the first and second tabs cooperate with the first groove 42 and the recessed portion 46 to secure the cover portion 50 to the body portion 12. As the first and second tabs 62 and 68 on the cover portion 50 cooperate with the groove 42 and the recessed portion 46 to grip the body portion 12 and thereby act as securing means for removably securing the reflector member to the body portion 12.

The cover portion 50 may therefore be referred to as a cover apparatus for covering a light reflecting strip on a body portion of a vehicle area marker, the body portion having a top portion with a groove therein and a bottom portion with a recessed portion, the cover apparatus comprising a member having a light transmitting portion for covering the light reflecting strip, a top portion connected to the light transmitting portion, the top portion having a tab operable to be received in said groove and a tab connected to the light transmitting portion and cooperating with the recessed portion to removably secure the member to the body portion.

The use of the recessed portion 46 and the first groove 42 permit the cover portion 50 to be removed from the body portion 12, even when the apparatus is installed on a road and without removing the apparatus from the road. A screwdriver may be used to pry the cover portion off of the body portion. While this may result in breakage of the cover portion, it permits the cover portion 50 to be replaced in the event that it becomes damaged due to moisture ingress or mechanical fatigue.

Light impinging upon the cover portion is transmitted through the light transmitting portion 54, transmitted through the cavity 59 and impinges upon the strip of light reflective tape 52. Light reflected by the strip of reflective tape 52 passes through the cavity 59 and through the light transmitting portion 54 and into the ambient air and appears as reflected light to a driver of a passing vehicle. The cover portion 50 and strip of reflective tape 52 act as reflecting means secured to at least one of the first and second face sides for reflecting light generally directed at the face sides and the cover portion acts as a resilient cover member for covering the light reflecting member, which in this embodiment is the reflective tape.

ALTERNATIVES

FIG. 5

Figure 5:
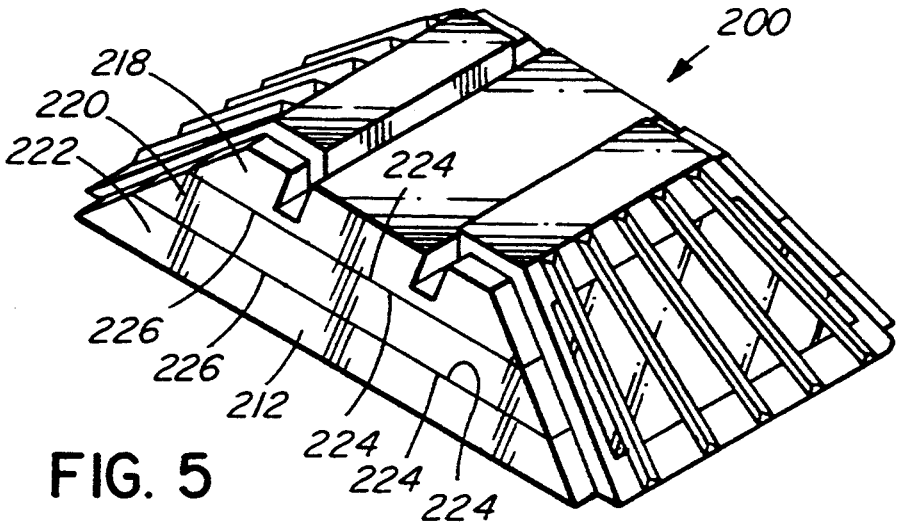
FIG. 5 is a perspective view of an apparatus according to a second embodiment of the invention.

Referring to FIG. 5, an apparatus according to a second embodiment of the invention is shown generally at 200. In this embodiment, the body portion 12 of FIG. 1 is replaced with a body 212 formed from first, second and third rectangular slabs 218, 220, 222 of used rubber tire, laminated together to form a solid, unitary body. Each rubber slab has a contacting surface 224 for contacting an adjacent slab. To laminate the slabs together, rubber cement 226 is applied to the contacting surfaces, the slabs are placed in positions as shown, and a press (not shown) is used to apply pressure to the slabs while the rubber cement cures.

Figure 6:
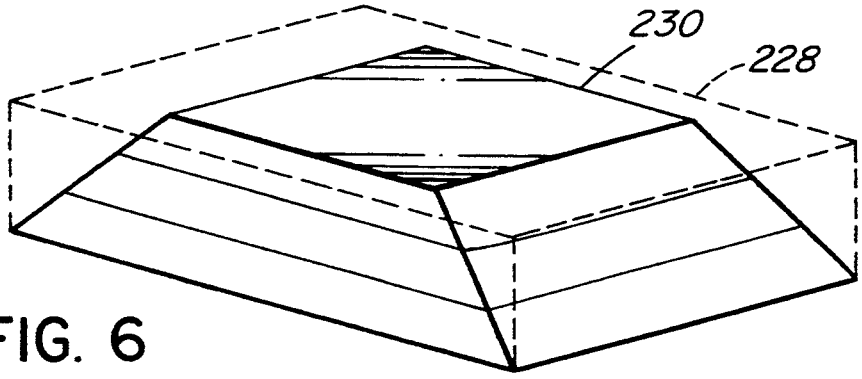
FIG. 6 is a perspective view of a block formed during an intermediate stage of making the apparatus of FIG. 5.

Referring to FIG. 6, the rubber cement cures, thereby binding the slabs 218, 220 and 222 together to form a solid rectangular block as shown in broken outline at 228. The rectangular block 228 is then cut along solid lines 230 to form a body having a truncated pyramidal shape as seen best in FIG. 5. Otherwise, the apparatus shown in FIGS. 5 and 6 is generally the same as the apparatus according to the first embodiment.

FIG. 7

Figure 7:
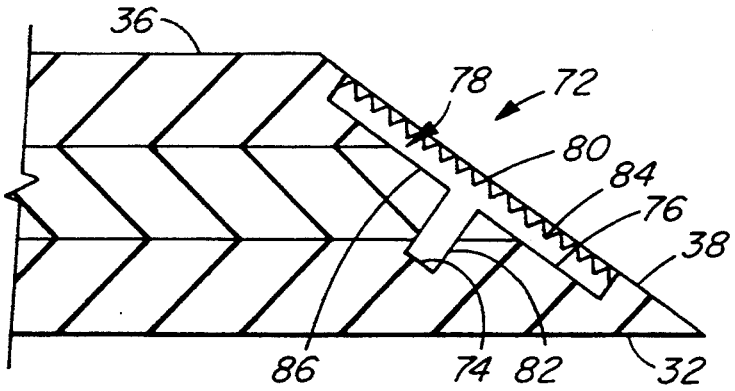
FIG. 7 is a cross-sectional view of an end portion of an apparatus according to a third embodiment of the invention.

Referring to FIG. 7, an apparatus according to a third embodiment of the invention, exhibiting an alternative reflector arrangement, is shown generally at 72. In this embodiment, the recessed portions 46 and 48 adjacent the first and second face sides and the first and second grooves 42 and 44 in the top surface 36 have been omitted and substituted with a transversely extending groove 74 and a transversely extending recessed portion 76 formed in the first face side 38. In this embodiment the reflecting means includes a T-shaped reflecting member 78 having a generally planar portion 80 and an orthogonal projection 82 projecting outwardly therefrom. The planar portion 80 is formed with a plurality facets, one of which is shown generally at 84. The facets are moulded into a rear surface 86 of the reflecting member and are operable to reflect light impinging thereon. The planar and orthogonal portions are dimensioned to be received and held tightly in the groove 74 and the recessed portion 76 respectively. Each time a vehicle drives over the device, the connection between the reflector portion and the body is further reinforced. However, it is possible to pry the reflector portion from the body when desired, for replacement of the reflector portion. It will be appreciated that it is not necessary to remove the body from the road surface to remove the reflector portion and therefore, the apparatus can be serviced in-situ.

The T-shaped reflecting member therefore acts as a reflector for use on a body portion of a vehicle area marker, the body portion having a face portion with a receptacle therein, the reflector comprising a member having a light reflecting portion for reflecting light impinging thereon and a projection extending outwardly from said light reflecting portion, the projection cooperating with the receptacle such that the projection is removably held by the receptacle thereby removably securing the member to the body.

In a variation of this embodiment, the planar portion 80 has a plurality of ribs (not shown) such as shown in FIG. 1, to provide a degree of protection against scratching.

FIG. 8

Figure 8:
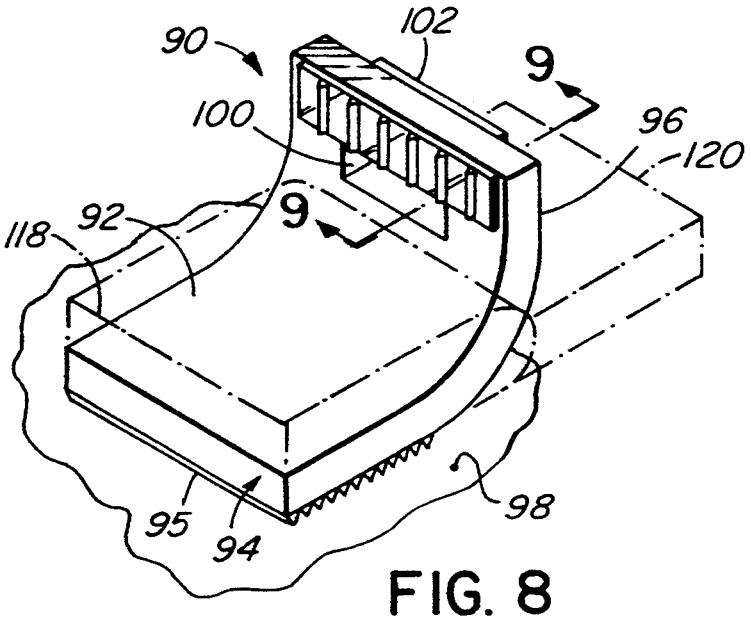
FIG. 8 is a perspective view of an apparatus according to a fourth embodiment of the invention.

Referring to FIG. 8, an apparatus according to a fourth embodiment of the invention is shown generally at 90. The apparatus includes a single slab 92 of a portion of a rubber tire, formed by taking radial cuts through a tread portion and sidewall portion of the tire. The apparatus therefore includes a tread portion 94 and an upstanding, sidewall portion 96, the upstanding portion being naturally disposed at an approximate right angle to the tread portion 94. It will be appreciated that rubber tires are formed with an approximate right angle as indicated and therefore easily serve as the preferred material for the apparatus.

The tread portion 94 has an attachment surface 95 which can be treated with bonding agent such as POWERBOND 10EL as described above, to secure the tread portion to the road surface 98, thereby securing the apparatus to the road.

FIG. 9

Figure 9:
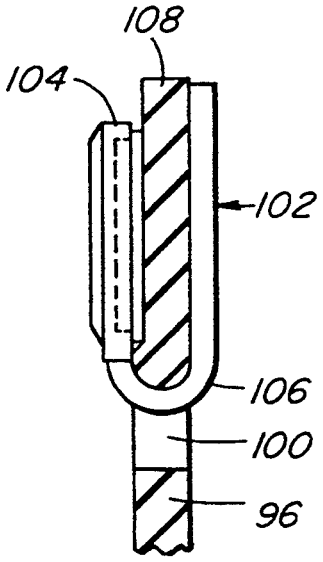
FIG. 9 is a cross-sectional view of an upstanding portion of the apparatus of FIG. 8.

The upstanding portion has a rectangular opening 100 extending transversely therein. Referring to FIG. 9, a clip 102 having a reflecting member 104 and a J-shaped clip portion 106 is received in the opening such that a portion 108 of the upstanding portion 96 is snugly received between the reflecting member and the J-shaped portion. The clip 102 is formed from flexible polycarbonate having sufficient resilience to permit the reflecting member 104 and the J-shaped clip portion 106 to be spread apart sufficiently to enable the clip to be installed on the upstanding portion 96 and with sufficient resilience to cause the upstanding portion to be snugly held by friction between the polycarbonate of the clip and the rubber of the upstanding portion. This eliminates any need for glue during manufacture of the apparatus.

FIG. 10

Figure 10:
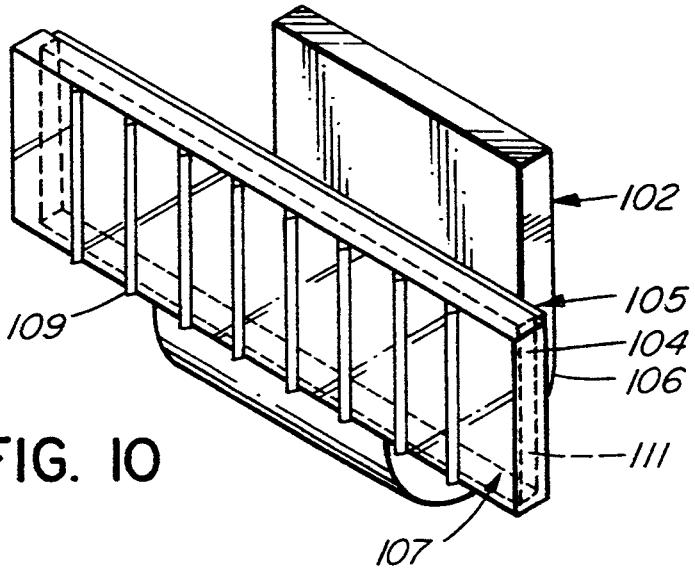
FIG. 10 is a perspective view of a clip according to the fourth embodiment of the invention.

Referring to FIG. 10, the reflecting member 104 has inwardly and outwardly directed faces 105 and 107. The outwardly directed face 107 has a plurality of transversely extending ribs 109 which provide a degree of scratch resistance to the face. The inwardly directed face 105 has a generally rectangular cavity shown in broken outline at 111. A strip of reflective tape 113 is ultrasonically welded to the inwardly directed face 105 such that the cavity 111 is covered thereby. The second upstanding portion therefore may be considered to have a rectangular opening and reflecting means including a clip removably securable to the second upstanding portion, the clip including a reflecting member and a resilient clip portion parallel to and spaced apart from the reflecting member such that a portion of the second upstanding portion is received between the reflecting portion and the clip portion.

Referring back to FIG. 8, an advantage of using a portion of a rubber tire to form the apparatus is that the rubber tire is flexible, elastic and resilient enough to permit the upstanding portion 96 to be bent entirely over, onto the tread portion 94, as shown in broken outline at 118 in the event that a vehicle drives over the device from a side opposite the tread portion. Similarly, the same qualities of the rubber tire permit the upstanding portion 96 to be bent entirely over, in an opposite direction, as shown in broken outline at 120. In effect therefore, the apparatus is sufficiently elastic to permit the second upstanding portion to be bent to angles of between approximately 0 and 180 degrees relative to the tread portion. The single slab 92 therefore acts as a resilient, elastic, generally rectangular member having a first portion having an attachment surface and a second upstanding portion, upstanding relative to the first portion, the member being sufficiently elastic to permit the second upstanding portion to be bent to angles up to approximately 180 degrees relative to the first portion. In addition, the clip 102 acts as reflecting means secured to the second upstanding portion for reflecting light generally directed at the upstanding portion.

Whether the upstanding portion is bent to 0 degrees or 180 degrees, a vehicle driving over the apparatus will tend to push the clip 102 further onto the upstanding portion 96, thereby serving to reinforce the grip of the clip 102 on the upstanding portion. It will be appreciated that in the event that the clip 102 becomes damaged due to mechanical fatigue or moisture ingress, the clip may be replaced without requiring the tread portion from being removed from the road surface. Thus the apparatus is in-site serviceable and can be refurbished at lower cost than would otherwise be incurred if it was necessary to remove the apparatus from the road surface.

FIG. 11

Figure 11:
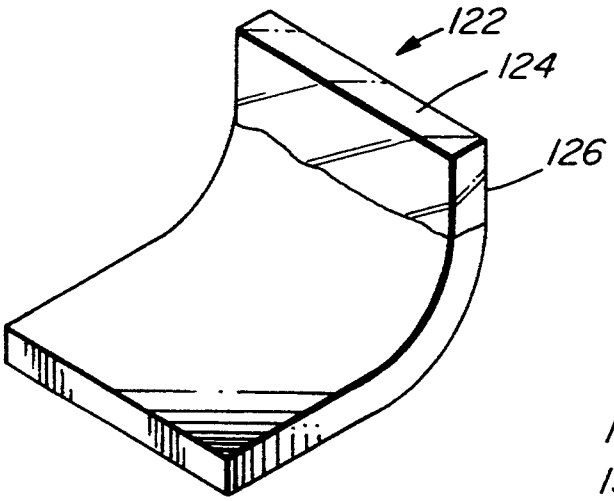
FIG. 11 is a perspective view of an apparatus according to a fifth embodiment of the invention.

Referring to FIG. 11, an apparatus according to a fifth alternative embodiment of the invention is shown generally at 122. This embodiment is generally the same as the fourth embodiment, shown in FIG. 8, with the exception that the rectangular opening 100 and clip 102 have been omitted and substituted with a coating of fluorescent paint 124 applied to an upper portion 126 of the upstanding portion 96. The fluorescent paint acts as reflecting paint and reflecting means for reflecting light directed at the upstanding portion. This embodiment is economically favourable and can be refurbished simply by applying a new coating of fluorescent paint.

FIG. 12

Figure 12:
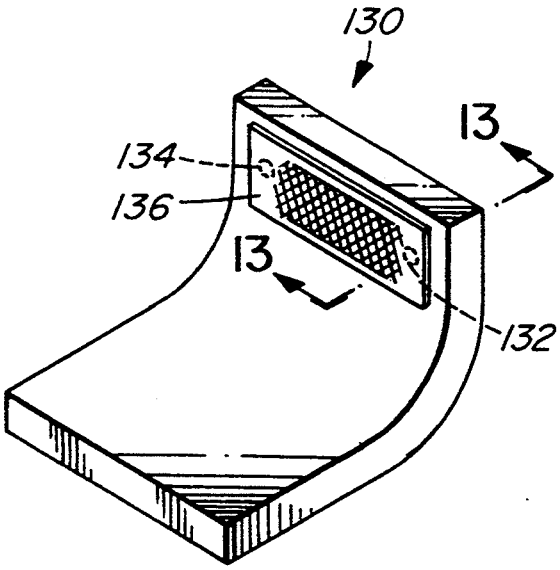
FIG. 12 is a perspective view of an apparatus according to a sixth embodiment of the invention.

Referring to FIG. 12, an apparatus according to a sixth alternative embodiment of the invention is shown generally at 130. This embodiment is generally the same as the fourth embodiment with the exception that the rectangular opening 100 and clip 102 have been omitted and substituted with first and second circular openings 132 and 134 and first and second connectable reflecting portions 136 and 138, only the first connectable reflecting portion 136 being shown in FIG. 8.

FIG. 13

Figure 13:
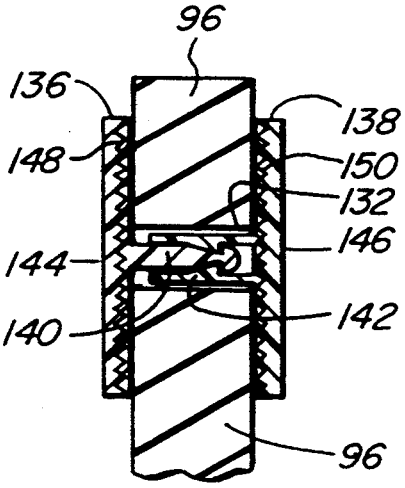
FIG. 13 is a cross-sectional view of an upstanding portion of the apparatus of FIG. 12.

Referring to FIG. 13, the first connectable reflecting portion 136 has first and second projections, only the first projection 140 being shown in FIG. 13, the second projection being similar, but disposed on an opposite side of the reflecting portion, for insertion through the second opening 134. The first projection is inserted through the first opening 132 and is received in a complementary receptacle 142 projecting from the second connectable reflecting portion 138. The first projection 140 and the complementary receptacle 142 are dimensioned such that a portion of the upstanding portion 96 is gripped and squeezed tightly between the first and second connectable reflecting portions 136 and 138, thereby securing the first and second connectable reflecting portions to the upstanding portion 96.

The first and second connectable portions have first and second outwardly directed surfaces 144 and 146 respectively and have respective faceted portions 148 and 150 immediately behind the outwardly directed surfaces, for reflecting light generally directed at the upstanding portion 96. The first and second connectable portions therefore act as reflecting means secured to the upstanding portion, for reflecting light directed at the upstanding portion. Therefore, it may be said that the reflecting means includes first and second reflecting members on opposite sides of the upstanding portion. It may also be stated that the first and second reflecting members have securing means for removably securing the first and second reflecting members to each other, the securing means including a projection on one of the first and second reflecting members and a receptacle on the other of the first and second receptacles, the projection and receptacle extending through an opening in the upstanding portion, and connecting to each other.

It will be appreciated that the first and second connectable portions can be separated from each other by simply breaking the connection therebetween and the first and second connectable portions can be removed from the upstanding portion while the tread portion is affixed to the road surface, thereby permitting easy refurbishing of the device.

FIG. 14

Figure 14:
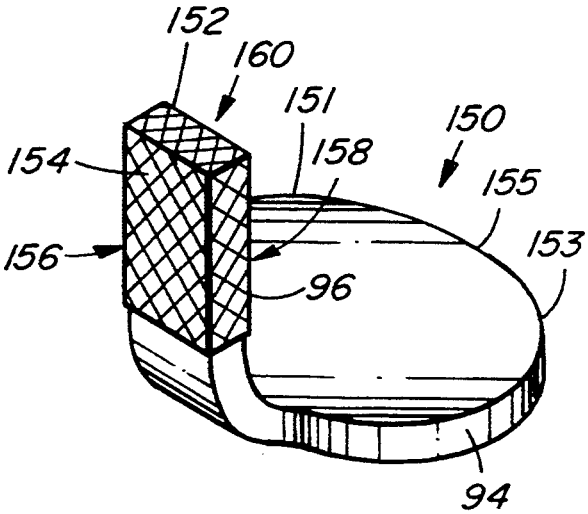
FIG. 14 is a perspective view of an apparatus according to a seventh embodiment of the invention.

Referring to FIG. 14, an apparatus according to a seventh embodiment of the invention is shown generally at 150. This embodiment is generally similar to the fourth embodiment, shown in FIG. 8, however, in this embodiment, the tread portion 94 has a greater mass than the upstanding portion 96 such that the apparatus has a low centre of gravity, thereby tending to keep the apparatus oriented such that the tread portion 94 is generally below the upstanding portion 96, i.e. the upstanding portion 96 is upright. The greater mass in the tread portion 94 is provided by making the tread portion 94 much wider than the upstanding portion 96, preferably by a ratio of 5:1. Thus it may be stated that the tread portion acts as a first portion having a greater mass than the upstanding portion such that the apparatus has a low centre of gravity, thereby tending to keep the apparatus oriented such that the first portion is generally below the upstanding portion.

In addition to the greater mass of the tread portion 94, the apparatus also has rounded corner portions 151 and 153 which reduce any tendency of the apparatus to rest upside down (relative to the orientation shown in the drawing). Should the apparatus be knocked by a vehicle into an upside down orientation, the rounded corner portions 151 and 153 enable the apparatus to be rolled on an edge 155 into the upright position shown in FIG. 14.

In addition, the apparatus is fitted with a plastic, reflective cover 152, having a plurality of facets 154 which act as reflecting means. Preferably, the plastic reflective cover 152 is formed with a plurality of panels, only three of which are shown at 156, 158 and 160, each panel having a construction similar to the construction of conventional bicycle-type reflectors.

Use of the apparatus according to the seventh embodiment is envisaged to be temporary with respect to the road and, therefore, the tread portion 94 is not intended to be secured to the road, but rather the mass of the tread portion 94 is intended to maintain the apparatus on the road and maintain the apparatus in an upright position as shown in FIG. 10. It would however, be possible to apply a bonding agent such as that described above to bond the tread portion to the road surface, if desired.

In alternative embodiments, not shown, the plastic reflective cover 152 in the embodiment shown in FIG. 14 may be substituted with a coating of reflective paint, or with the reflecting means described in connection with the fourth embodiment, shown in FIG. 8, or with the reflecting means described in connection with the sixth embodiment, shown in FIG. 12, with suitable dimensional alterations as necessary.

In general, the use of each of the apparatuses described above may be summarized as a method of marking a point in a vehicular traffic area, the method comprising the steps of:

a) attaching to said point, a body formed entirely from at least a portion of a rubber tire, the body having a reflecting surface thereon; and b) using the reflecting surface to reflect light received from the lights of nearby vehicles, such that reflected light is directed back at the vehicle from which light is received.

According to another aspect of the invention, each of the reflecting means described is capable of being used on vehicle area markers in general, where provisions such as those described above have been provided for their mounting. The reflector clip described in connection with the embodiment described with reference to FIGS. 8, 9 and 10, has more general application as a suitably sized portion of a vehicle area marker may simply be gripped between the reflector member and the J-shaped clip portion. Therefore, in general, it may be stated that the reflector clip shown in FIGS. 8, 9, and 10 may be referred to as a reflector for use on a vehicle area marker, the reflector comprising a member removably securable to the vehicle area marker, the member including a reflecting member and a resilient clip portion parallel to and spaced apart from the reflecting member such that a portion of the vehicle area marker is received and gripped between the reflecting portion and the clip portion.

While specific embodiments of the invention have been described and illustrated, such embodiments should be considered illustrative of the invention only and not as limiting the invention as construed in accordance with the accompanying claims.

What is claimed is:

1. A reflective marker apparatus for use in a vehicular traffic area, the apparatus comprising:

a) a resilient, elastic body portion formed from at least two portions of a rubber tire laminated together, the body having an attachment surface bondable to a mounting surface, a top surface opposite the attachment surface and first and second oppositely disposed face sides angularly disposed relative to said attachment surface to be convergent toward said top surface; and b) reflecting means for reflecting light generally directed at the body, the reflecting means including a light: reflecting member and a resilient cover member for covering the light reflecting member; and c) securing means for removably securing the cover member to at least one of the first and second face sides such that the cover member may be removed from the body potion as desired, the receiving means including:

i) a recessed portion in said attachment surface of said body portion and a groove extending transversely in said top surface of said body portion; and ii) first and second tabs on the cover member for cooperating with said recessed portion and said groove respectively, to grip the body portion to secure the cover member to the body, the cover member being sufficiently resiliently bendable to permit installation thereof without requiring the removal of the apparatus from the mounting surface.

2. A reflective marker apparatus as claimed in claim 1 wherein the cover member has a light transmitting portion operable to lie adjacent one of said first and second oppositely disposed face sides, the light transmitting portion having a front portion, a rear portion and upper and lower portions.

3. A reflective marker apparatus as claimed in claim 2 where in the front portion has a plurality of generally triangular-shaped ribs extending between the upper portion and the lower portion.

4. A reflective marker apparatus as claimed in claim 2 wherein the rear portion has a rectangular cavity therein for holding the light reflecting member, the cavity lying between the light transmitting portion and the light reflecting member.

5. A reflective marker apparatus as claimed in claim 2 wherein said first tab is disposed at an angle relative to said light transmitting portion.

6. A reflective marker apparatus as claimed in claim 5 wherein said second tab is disposed at a right angle to said first tab.

7. A reflective marker apparatus as claimed in claim 6 wherein said cover member includes a top portion connected between the second tab and the light transmitting portion, the top portion being parallel with the first tab and parallel with the top surface of said body.

* * * * *